US011616298B2

(12) United States Patent
Tsai

(10) Patent No.: US 11,616,298 B2
(45) Date of Patent: Mar. 28, 2023

(54) ANTENNA SYSTEM

(71) Applicant: Wistron NeWeb Corp., Hsinchu (TW)

(72) Inventor: Yi-Che Tsai, Hsinchu (TW)

(73) Assignee: WISTRON NEWEB CORP., Hsinchu (TW)

( * ) Notice: Subject to any disclaimer, the term of this patent is extended or adjusted under 35 U.S.C. 154(b) by 29 days.

(21) Appl. No.: 17/471,471

(22) Filed: Sep. 10, 2021

(65) Prior Publication Data

US 2022/0231414 A1 Jul. 21, 2022

(30) Foreign Application Priority Data

Jan. 15, 2021 (TW) ..... 110101593

(51) Int. Cl.

| | |
|---|---|
| ***H01Q 1/22*** | (2006.01) |
| ***H01Q 3/36*** | (2006.01) |
| ***H01Q 9/04*** | (2006.01) |
| ***H01Q 9/42*** | (2006.01) |

(52) U.S. Cl.

CPC ..... *H01Q 3/36* (2013.01); *H01Q 1/2291* (2013.01); *H01Q 9/0407* (2013.01); *H01Q 9/42* (2013.01)

(58) Field of Classification Search

CPC ..... H01Q 3/36; H01Q 1/2291; H01Q 9/0407; H01Q 9/42; H01Q 1/243; H01Q 9/0421; H01Q 21/28

See application file for complete search history.

(56) References Cited

U.S. PATENT DOCUMENTS

| | | | | |
|---|---|---|---|---|
| 2016/0020838 | A1 | 1/2016 | Desclos et al. | |
| 2020/0303840 | A1* | 9/2020 | Singh | H01Q 9/42 |
| 2020/0348380 | A1* | 11/2020 | Taracila | G01R 33/3657 |
| 2022/0109220 | A1* | 4/2022 | Gorbachov | H01Q 3/36 |

FOREIGN PATENT DOCUMENTS

TW 201616807 A 5/2016

* cited by examiner

*Primary Examiner* — Hai V Tran
*Assistant Examiner* — Michael M Bouizza
(74) *Attorney, Agent, or Firm* — McClure, Qualey & Rodack, LLP

(57) ABSTRACT

An antenna system includes a tunable impedance circuit, a power splitter, a first phase shifter, a second phase shifter, a third phase shifter, a fourth phase shifter, a first antenna element, a second antenna element, a third antenna element, a fourth antenna element, a first switch element, a second switch element, a third switch element, and a fourth switch element. The first switch element selectively couples the first antenna element through the first phase shifter to the power splitter. The second switch element selectively couples the second antenna element through the second phase shifter to the power splitter. The third switch element selectively couples the third antenna element through the third phase shifter to the power splitter. The fourth switch element selectively couples the fourth antenna element through the fourth phase shifter to the power splitter.

18 Claims, 10 Drawing Sheets

300

350

ANTENNA SYSTEM

CROSS REFERENCE TO RELATED APPLICATIONS

This application claims priority of Taiwan Patent Application No. 110101593 filed on Jan. 15, 2021, the entirety of which is incorporated by reference herein.

BACKGROUND OF THE INVENTION

Field of the Invention

The disclosure generally relates to an antenna system, and more particularly, to an antenna system with low complexity and high efficiency.

Description of the Related Art

With the advancements being made in mobile communication technology, mobile devices such as portable computers, mobile phones, multimedia players, and other hybrid functional portable electronic devices have become more common. To satisfy consumer demand, mobile devices can usually perform wireless communication functions. Some devices cover a large wireless communication area; these include mobile phones using 2G, 3G, and LTE (Long Term Evolution) systems and using frequency bands of 700 MHz, 850 MHz, 900 MHz, 1800 MHz, 1900 MHz, 2100 MHz, 2300 MHz, and 2500 MHz. Some devices cover a small wireless communication area; these include mobile phones using Wi-Fi and Bluetooth systems and using frequency bands of 2.4 GHz, 5.2 GHz, and 5.8 GHz.

Wireless access points are indispensable elements for mobile devices in a room to connect to the Internet at a high speed. However, since an indoor environment can experience serious signal reflection and multipath fading, wireless access points should process signals from a variety of transmission directions simultaneously. Accordingly, it has become a critical challenge for antenna designers to design an antenna system with low complexity and high efficiency in the limited space of a wireless access point.

BRIEF SUMMARY OF THE INVENTION

In an exemplary embodiment, the invention is directed to an antenna system that includes a tunable impedance circuit, a power splitter, a first phase shifter, a second phase shifter, a third phase shifter, a fourth phase shifter, a first antenna element, a second antenna element, a third antenna element, a fourth antenna element, a first switch element, a second switch element, a third switch element, and a fourth switch element. The power splitter has a common port, a first port, a second port, a third port, and a fourth port. The common port of the power splitter is coupled to the tunable impedance circuit. The first phase shifter provides a first compensation phase. The second phase shifter provides a second compensation phase. The third phase shifter provides a third compensation phase. The fourth phase shifter provides a first compensation phase. The first switch element selectively couples the first antenna element through the first phase shifter to the first port of the power splitter. The second switch element selectively couples the second antenna element through the second phase shifter to the second port of the power splitter. The third switch element selectively couples the third antenna element through the third phase shifter to the third port of the power splitter. The fourth switch element selectively couples the fourth antenna element through the fourth phase shifter to the fourth port of the power splitter.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

In order to illustrate the purposes, features and advantages of the invention, the embodiments and figures of the invention are shown in detail as follows.

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". The term "substantially" means the value is within an acceptable error range. One skilled in the art can solve the technical problem within a predetermined error range and achieve the proposed technical performance. Also, the term "couple" is intended to mean either an indirect or direct electrical connection. Accordingly, if one device is coupled to another device, that connection may be through a direct electrical connection, or through an indirect electrical connection via other devices and connections.

Figure 1:
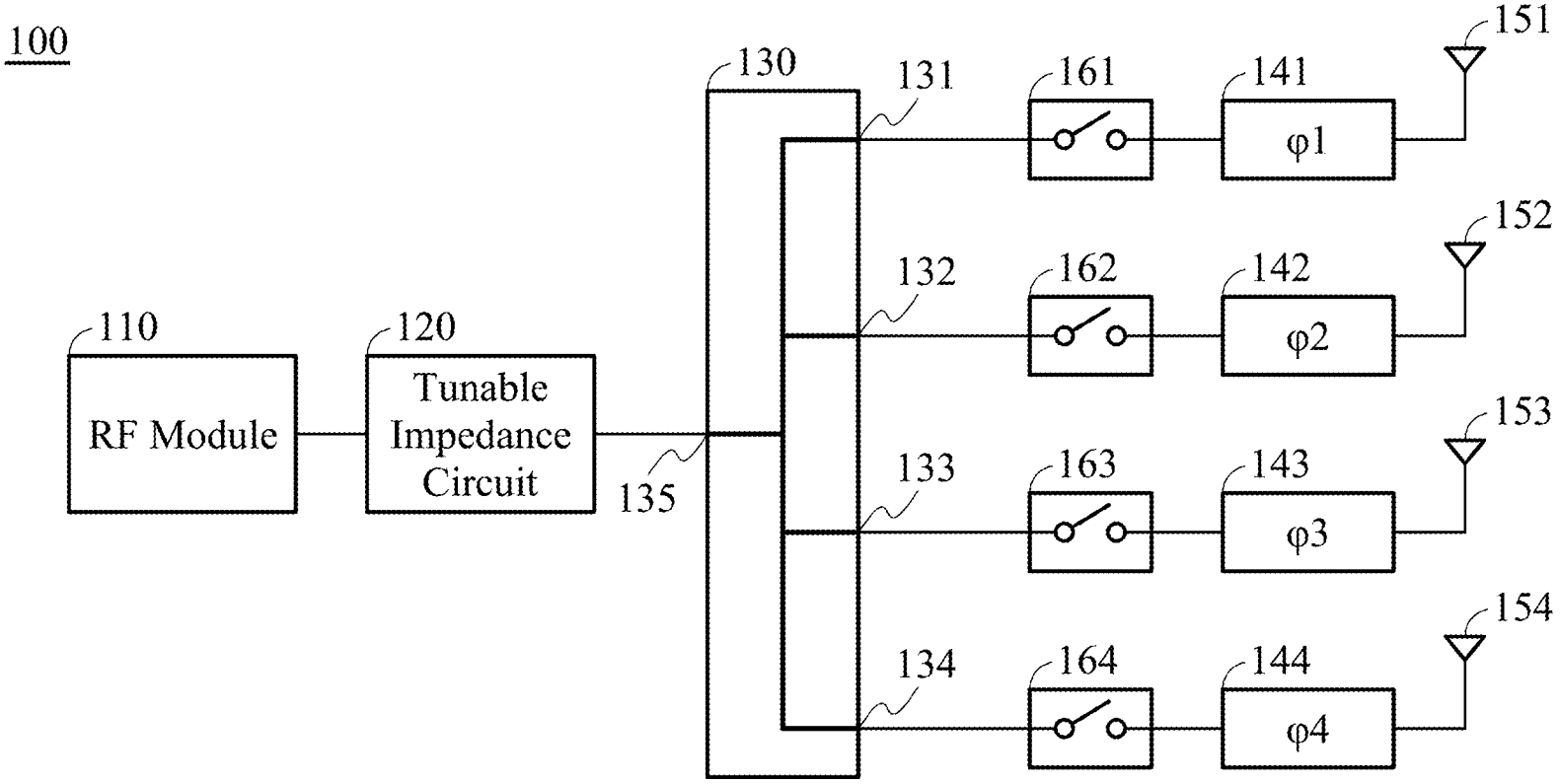
FIG. 1 is a diagram of an antenna system according to an embodiment of the invention.

FIG. 1 is a diagram of an antenna system 100 according to an embodiment of the invention. The antenna system 100 may be applied to a router or a wireless access point. As shown in FIG. 1, the antenna system 100 includes a tunable impedance circuit 120, a power splitter 130, a first phase shifter 141, a second phase shifter 142, a third phase shifter 143, a fourth phase shifter 144, a first antenna element 151, a second antenna element 152, a third antenna element 153, a fourth antenna element 154, a first switch element 161, a second switch element 162, a third switch element 163, and a fourth switch element 164. It should be understood that the antenna system 100 may further include other components, such as a power supply module and a housing, although they are not displayed in FIG. 1.

In some embodiments, the antenna system further includes an RF (Radio Frequency) module 110. The RF module 110 can transmit or receive and process an RF signal. For example, the RF module 110 may be a Bluetooth module, and the RF signal may be a Bluetooth signal. The tunable impedance circuit 120 is coupled to the RF module 110 and is configured to provide a variable impedance value.

The power splitter 130 has a first port 131, a second port 132, a third port 133, a fourth port 134, and a common port 135. The common port 135 of the power splitter 130 is coupled to the tunable impedance circuit 120. It should be understood that the signal transmission direction of the power splitter 130 is not limited in the invention. The power splitter 130 can be used as a divider or a combiner. When the power splitter 130 is used as a divider, it can divide the signal received from the common port 135, and can output the divided signals through the first port 131, the second port 132, the third port 133, and the fourth port 134, respectively. Conversely, when the power splitter 130 is used as a combiner, it can combine the signals received from the first port 131, the second port 132, the third port 133, and the fourth port 134, respectively, and can output the combined signal through the common port 135.

The first phase shifter 141 can provide a first compensation phase φ1 for the first antenna element 151. The second phase shifter 142 can provide a second compensation phase φ2 for the second antenna element 152. The third phase shifter 143 can provide a third compensation phase φ3 for the third antenna element 153. The fourth phase shifter 144 can provide a fourth compensation phase (p4 for the fourth antenna element 154. In some embodiments, each of the first compensation phase (p1, the second compensation phase φ2, the third compensation phase φ3, and the fourth compensation phase φ4 is substantially equal to 0 degrees, is from 280 to 300 degrees (or from −80 to −60 degrees), or is from 100 to 120 degrees. However, the invention is not limited thereto. In alternative embodiments, the first compensation phase φ1, the second compensation phase φ2, the third compensation phase φ3, and the fourth compensation phase φ4 can be adjusted to meet different requirements. It should be noted that if only three of the first antenna element 151, the second antenna element 152, the third antenna element 153, and the fourth antenna element 154 are used, the antenna element which is not used and the corresponding phase shifter and compensation phase may be omitted.

The first switch element 161, the second switch element 162, the third switch element 163, and the fourth switch element 164 may be closed or opened independently. The first switch element 161 can selectively couple the first antenna element 151 through the first phase shifter 141 to the first port 131 of the power splitter 130. The second switch element 162 can selectively couple the second antenna element 152 through the second phase shifter 142 to the second port 132 of the power splitter 130. The third switch element 163 can selectively couple the third antenna element 153 through the third phase shifter 143 to the third port 133 of the power splitter 130. The fourth switch element 164 can selectively couple the fourth antenna element 154 through the fourth phase shifter 144 to the fourth port 134 of the power splitter 130.

Figure 2A:
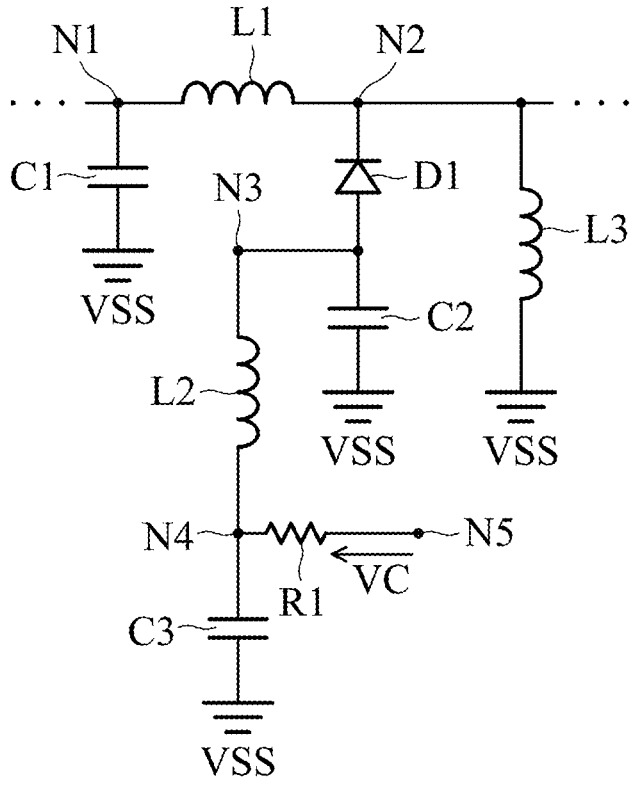
FIG. 2A is a diagram of a tunable impedance circuit according to an embodiment of the invention.

FIG. 2A is a diagram of the tunable impedance circuit 120 according to an embodiment of the invention. In the embodiment of FIG. 2A, the tunable impedance circuit 120 includes a first capacitor C1, a second capacitor C2, a third capacitor C3, a first inductor L1, a second inductor L2, a third inductor L3, a resistor R1, and a PIN (Positive Intrinsic Negative) diode D1, whose connections will be described as follows.

The first capacitor C1 has a first terminal coupled to a first node N1, and a second terminal coupled to a ground voltage VSS. The first inductor L1 has a first terminal coupled to the first node N1, and a second terminal coupled to a second node N2. The first node N1 may be coupled to the RF module 110. The second node N2 may be coupled to the common port 135 of the power splitter 130. The PIN diode D1 has an anode coupled to a third node N3, and a cathode coupled to the second node N2. The second capacitor C2 has a first terminal coupled to the third node N3, and a second terminal coupled to the ground voltage VSS. The second inductor L2 has a first terminal coupled to the third node N3, and a second terminal coupled to a fourth node N4. The third capacitor C3 has a first terminal coupled to the fourth node N4, and a second terminal coupled to the ground voltage VSS. The resistor R1 has a first terminal coupled to the fourth node N4, and a second terminal coupled to a fifth node N5 for receiving a control voltage VC. The third inductor L3 has a first terminal coupled to the second node N2, and a second terminal coupled to the ground voltage VSS. If the control voltage VC has a high logic level (e.g., a logic "1"), the PIN diode D1 will be turned on. Conversely, if the control voltage VC has a low logic level (e.g., a logic "0"), the PIN diode D1 will be turned off. Thus, the tunable impedance circuit 120 can generate a variable impedance value by changing the control voltage VC.

Figure 2B:
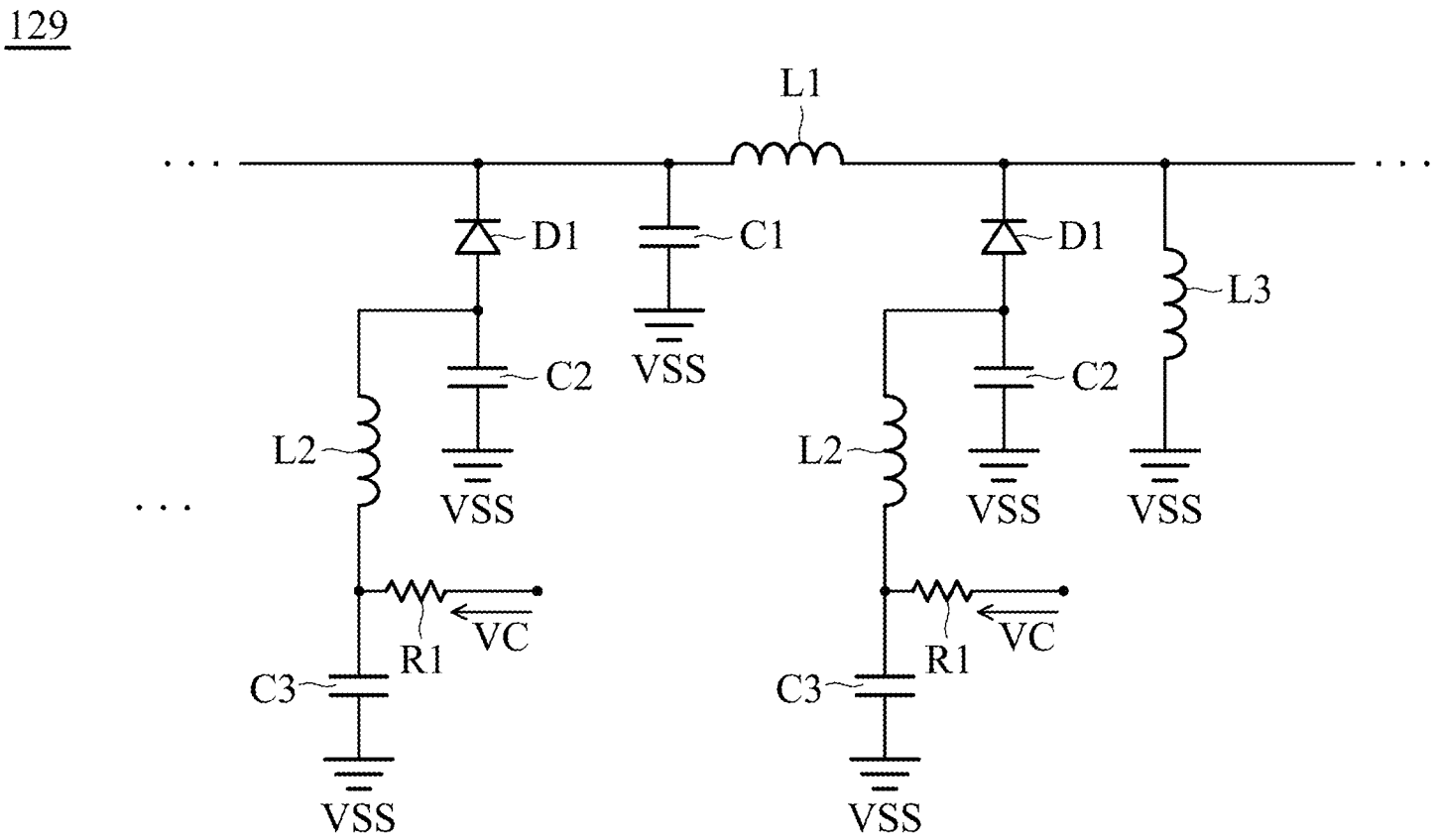
FIG. 2B is a diagram of a parallel combination of a tunable impedance circuits according to an embodiment of the invention.

FIG. 2B is a diagram of a parallel combination 129 of the tunable impedance circuits 120 according to an embodiment of the invention. In the embodiment of FIG. 2B, the antenna system 100 also includes a plurality of tunable impedance circuits 120, which are coupled in parallel with each other, so as to provide a variety of impedance values. For example, the PIN diode D1, the second capacitor C2, the third capacitor C3, the second inductor L2, and the resistor R1 can be duplicated to more, but they are not limited as above.

Figure 3A:
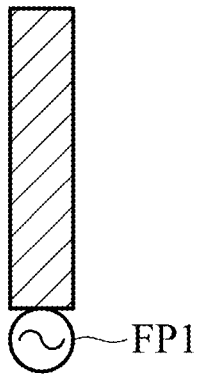
FIG. 3A is a diagram of a monopole antenna according to an embodiment of the invention.
Figure 3B:
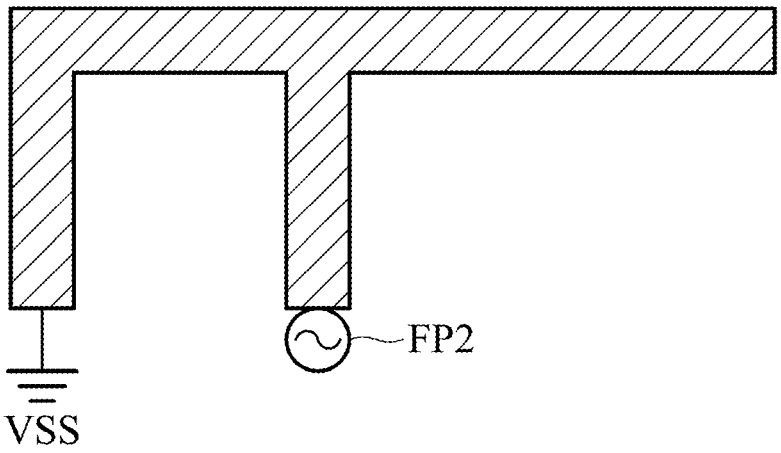
FIG. 3B is a diagram of a PIFA (Planar Inverted F Antenna) according to an embodiment of the invention.

FIG. 3A is a diagram of a monopole antenna 300 according to an embodiment of the invention. The monopole antenna 300 has a feeding point FP1. In some embodiments, each of the first antenna element 151, the second antenna element 152, the third antenna element 153, and the fourth antenna element 154 is a respective monopole antenna. FIG. 3B is a diagram of a PIFA (Planar Inverted F Antenna) 350 according to an embodiment of the invention. The PIFA 350 has a feeding point FP2, and it is further coupled to the ground voltage VSS. In some embodiments, each of the first antenna element 151, the second antenna element 152, the third antenna element 153, and the fourth antenna element 154 is a respective PIFA. However, the invention is not limited thereto. In alternative embodiments, each of the first antenna element 151, the second antenna element 152, the third antenna element 153, and the fourth antenna element 154 is a dipole antenna, a loop antenna, a hybrid antenna, or another type antenna.

In some embodiments, the first antenna element 151, the second antenna element 152, the third antenna element 153, and the fourth antenna element 154 have a common operation frequency which is substantially equal to 2.45 GHz.

Therefore, the antenna system 100 can at least support communication on the Bluetooth frequency band. It should be understood that the aforementioned common operation frequency can be adjusted to meet different requirements.

Figure 4:
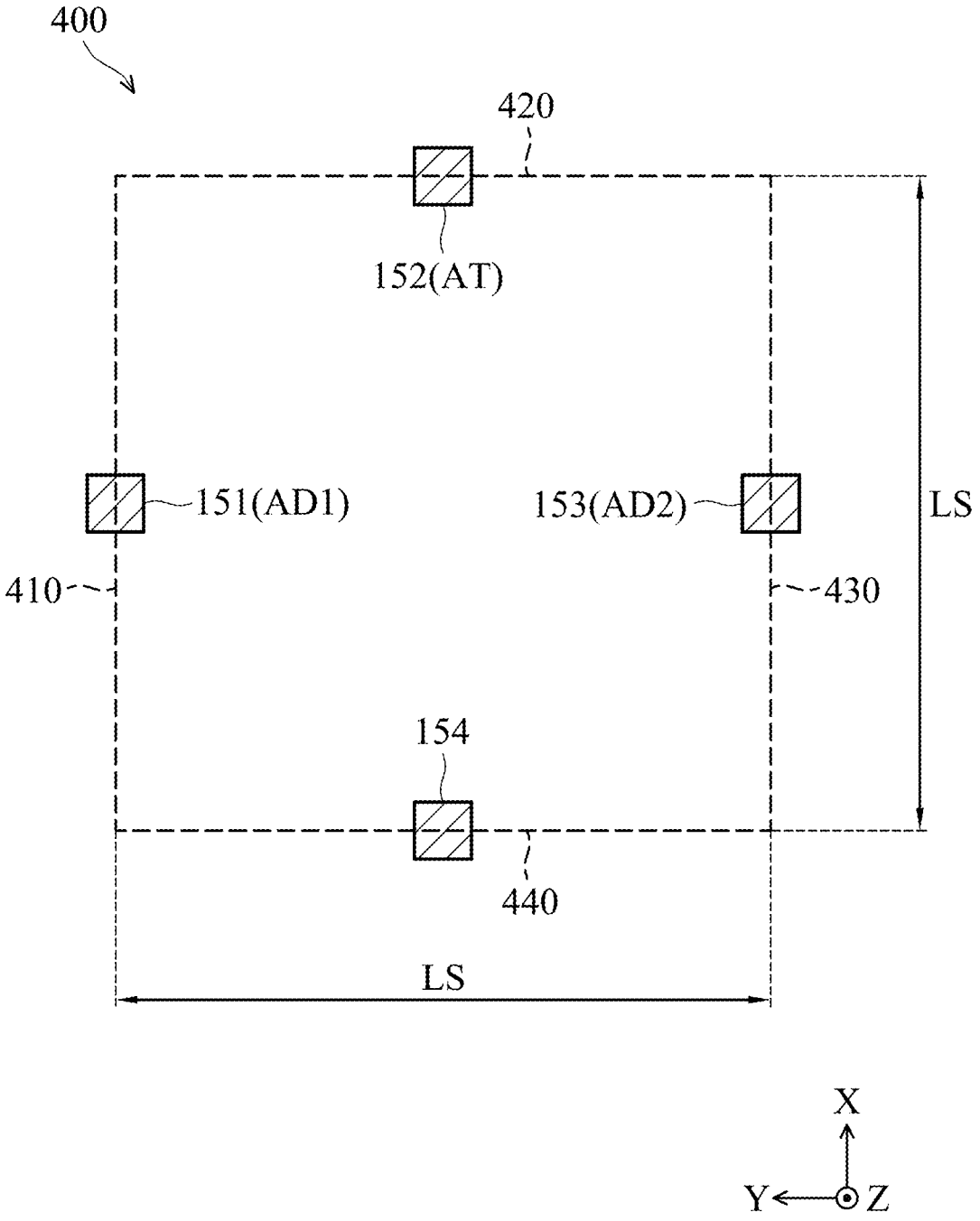
FIG. 4 is a diagram of arrangement of a first antenna element, a second antenna element, a third antenna element, and a fourth antenna element according to an embodiment of the invention.

FIG. 4 is a diagram of the arrangement of the first antenna element 151, the second antenna element 152, the third antenna element 153, and the fourth antenna element 154 according to an embodiment of the invention. In the embodiment of FIG. 4, the first antenna element 151, the second antenna element 152, the third antenna element 153, and the fourth antenna element 154 are arranged to surround a square shape 400. The square shape 400 may be disposed on the XY-plane. Specifically, the square shape 400 has a first side 410, a second side 420, a third side 430, and a fourth side 440. The first antenna element 151 may be positioned at the central point of the first side 410 of the square shape 400. The second antenna element 152 may be positioned at the central point of the second side 420 of the square shape 400. The third antenna element 153 may be positioned at the central point of the third side 430 of the square shape 400. The fourth antenna element 154 may be positioned at the central point of the fourth side 440 of the square shape 400. In some embodiments, the length LS of each of the first side 410, the second side 420, the third side 430, and the fourth side 440 of the square shape 400 is substantially equal to 0.5 wavelength ($\lambda/2$) of the aforementioned common operation frequency.

Figure 5:
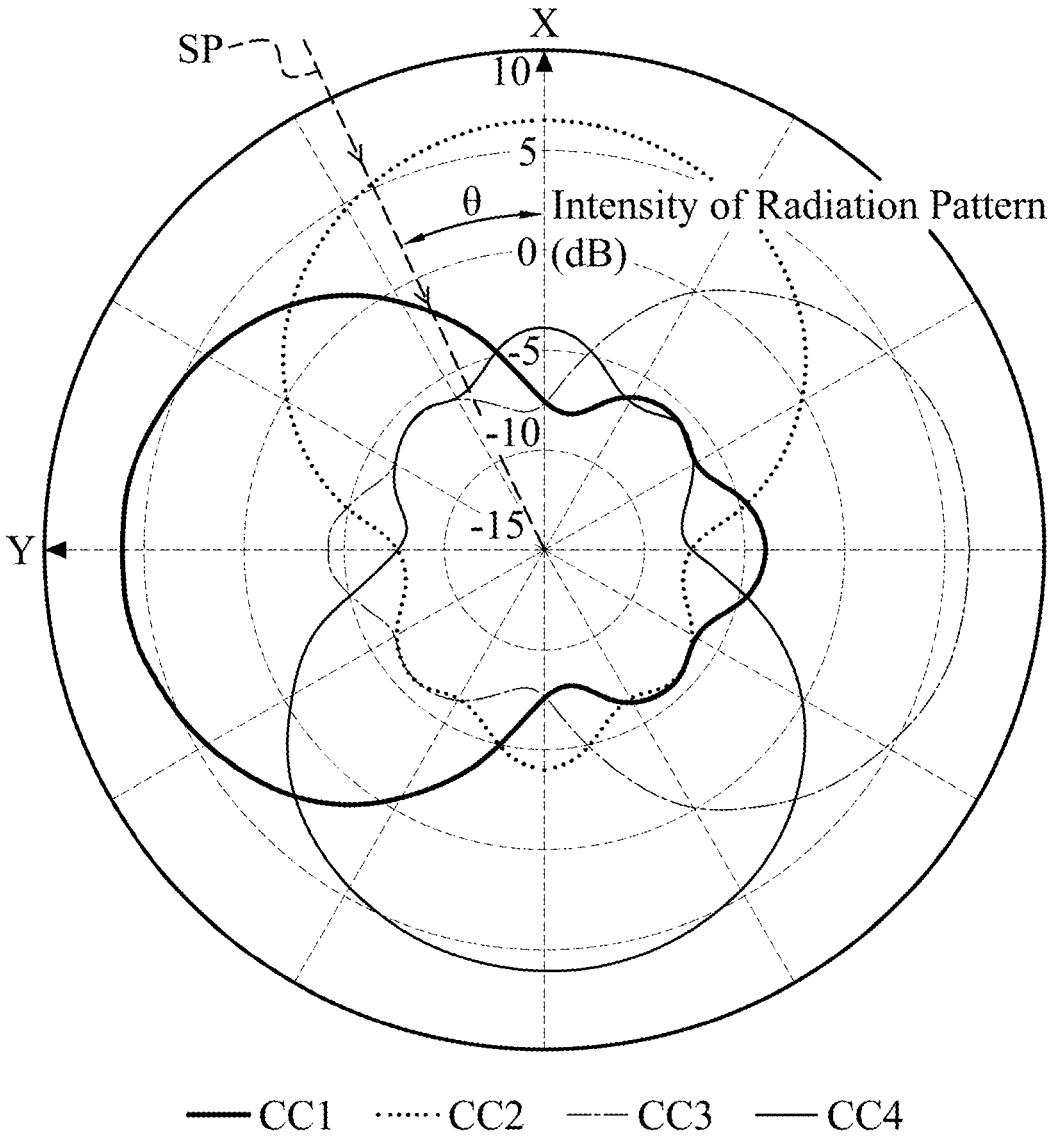
FIG. 5 is a diagram of radiation patterns of antenna combinations of an antenna system according to an embodiment of the invention.

FIG. 5 is a diagram of radiation patterns of antenna combinations of the antenna system 100 according to an embodiment of the invention. A first curve CC1, a second curve CC2, a third curve CC3, and a fourth curve CC4 represent all possible radiation patterns of the antenna combinations of the antenna system 100. According to the measurement of FIG. 5, the main beam direction of the antenna combinations of the antenna system 100 may be toward the +Y-axis, +X-axis, −Y-axis, or −X-axis. Regardless of any radiation patterns, the HPBW (Half-Power Beamwidth) of the antenna combinations of the antenna system 100 may be substantially equal to 90 degrees.

Figure 6:
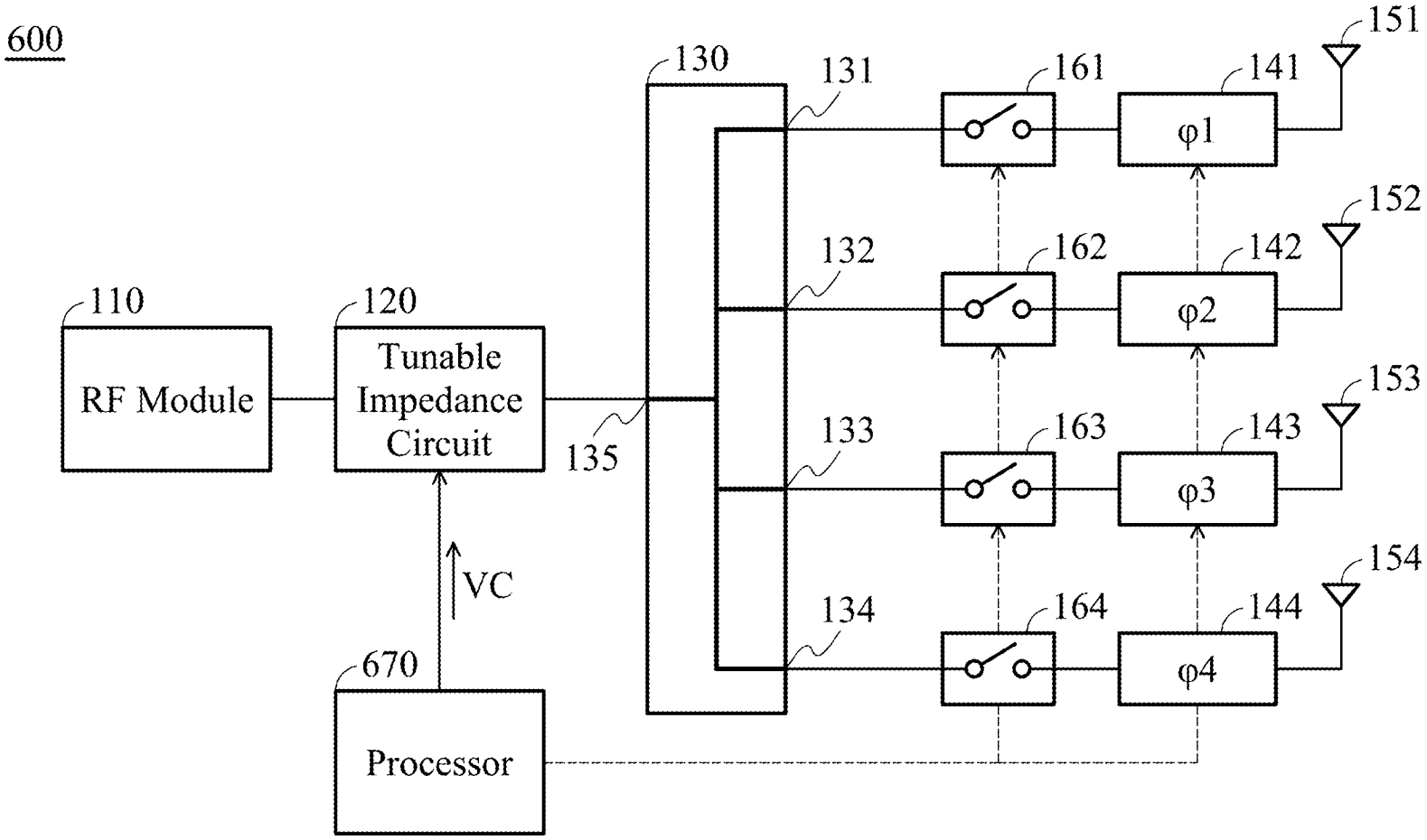
FIG. 6 is a diagram of an antenna system according to an embodiment of the invention.

FIG. 6 is a diagram of an antenna system 600 according to an embodiment of the invention. FIG. 6 is similar to FIG. 1. The difference between the two embodiments is that the antenna system 600 further includes a processor 670, which may be implemented with an IC (Integrated Circuit) chip. The processor 670 can generate the aforementioned control voltage VC, and can also control the first phase shifter 141, the second phase shifter 142, the third phase shifter 143, the fourth phase shifter 144, the first switch element 161, the second switch element 162, the third switch element 163, and the fourth switch element 164. Generally, the processor 670 can operate in a first stage and a second stage sequentially, and its operation principles will be described in the following embodiments.

During the first stage, the processor 670 can enable three of the first antenna element 151, the second antenna element 152, the third antenna element 153, and the fourth antenna element 154 by switching the first switch element 161, the second switch element 162, the third switch element 163, and the fourth switch element 164. For example, when a switch element is closed, the antenna element corresponding to the switch element can be enabled. Conversely, when a switch element is opened, the antenna element corresponding to the switch element can be disabled. Specifically, the processor 670 can selectively enable a first combination formed by the first antenna element 151, the second antenna element 152 and the third antenna element 153 (i.e., only the fourth antenna element 154 is disabled and the other antenna elements are all enabled), a second combination formed by the first antenna element 151, the second antenna element 152 and the fourth antenna element 154 (i.e., only the third antenna element 153 is disabled and the other antenna elements are all enabled), a third combination formed by the first antenna element 151, the third antenna element 153 and the fourth antenna element 154 (i.e., only the second antenna element 152 is disabled and the other antenna elements are all enabled), or a fourth combination formed by the second antenna element 152, the third antenna element 153 and the fourth antenna element 154 (i.e., only the first antenna element 151 is disabled and the other antenna elements are all enabled). For example, the above first combination, second combination, third combination, and fourth combination may correspond to the first curve CC1, second curve CC2, third curve CC3, and fourth curve CC4 of the radiation patterns of FIG. 5. Therefore, the antenna system 600 can provide a total radiation pattern which is almost omnidirectional on the XY-plane. In some embodiments, the processor 670 can select the above first combination, second combination, third combination, and fourth combination one after another, and can measure and compare the RSSIs (Received Signal Strength Indicators) corresponding to all of the combinations.

During the first stage, the processor 670 can also select one of the first antenna element 151, the second antenna element 152, the third antenna element 153, and the fourth antenna element 154 as a target antenna element AT according to a target signal SP. The target signal SP may be a wireless signal from an object under test. Specifically, the processor 670 can compare four different RSSIs of the target signal SP corresponding to the aforementioned four combinations, and can select the best combination thereof accordingly. For example, it is assumed that the first combination formed by the first antenna element 151, the second antenna element 152 and the third antenna element 153 corresponds to the maximum RS SI of the target signal SP (i.e., the best combination is the first combination), the processor 670 can select the second antenna element 152 between the first antenna element 151 and the third antenna element 153 as the target antenna element AT. Please refer to FIG. 4 and FIG. 5 together. If the second antenna element 152 is selected as the target antenna element AT, the radiation pattern of the antenna system 600 can substantially cover the DoA (Direction of Arrival) of the target signal SP, and the target antenna element AT (or the best combination) can correspond to the maximum RS SI of the target signal SP. Upon the criterion of +X-axis, the DoA of the target signal SP may have azimuth angle θ. It should be noted that based on similar operation principles, the first antenna element 151, the third antenna element 153, or the fourth antenna element 154 can be selected as the target antenna element AT under other circumstances.

In alternative embodiments, the processor 670 can enable all (or four) of the first antenna element 151, the second antenna element 152, the third antenna element 153, and the fourth antenna element 154 by switching the first switch element 161, the second switch element 162, the third switch element 163, and the fourth switch element 164. Next, the processor 670 can select a target antenna element AT according to a variety of RSSIs of the target signal SP.

During the second stage, the processor 670 can further select two of the first antenna element 151, the second antenna element 152, the third antenna element 153, and the fourth antenna element 154 as two detection antenna elements AD1 and AD2. The detection antenna elements AD1 and AD2 are both adjacent to the target antenna element AT.

For example, if the second antenna element 152 is selected as the target antenna element AT during the first stage, the processor 670 will select the first antenna element 151 and the third antenna element 153 as the detection antenna elements AD1 and AD2, respectively, during the second stage (because the first antenna element 151 and the third antenna element 153 are both adjacent to the target antenna element AT but the fourth antenna element 154 is opposite to the target antenna element AT).

Figure 7:
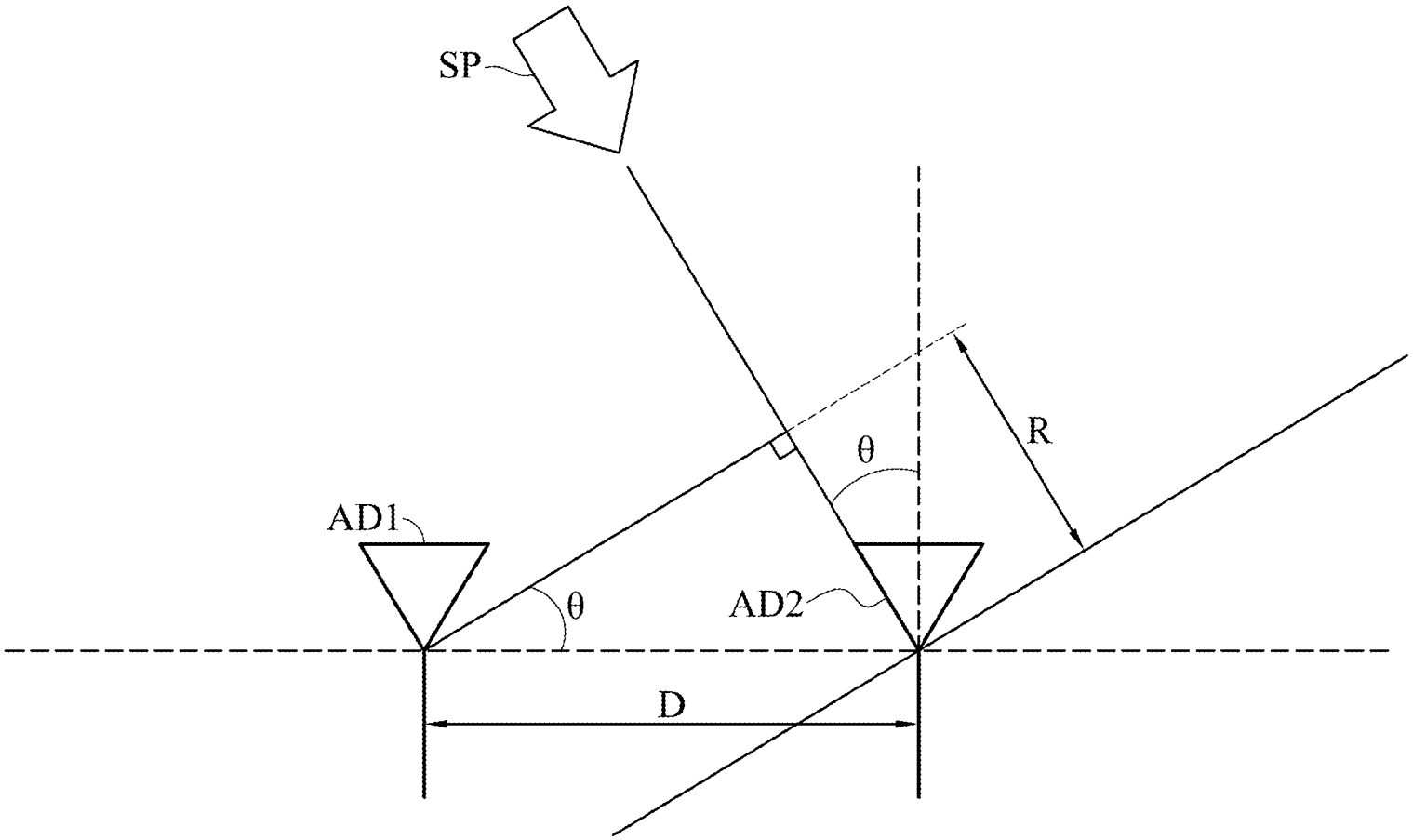
FIG. 7 is a diagram of AoA (Angle of Arrival) calculation operation according to an embodiment of the invention.

During the second stage, the processor 670 can perform an AoA (Angle of Arrival) calculation operation by using the detection antenna elements AD1 and AD2, so as to determine the azimuth angle θ of the target signal SP. FIG. 7 is a diagram of the AoA calculation operation according to an embodiment of the invention. In the embodiment of FIG. 7, there is a distance D between the detection antenna elements AD1 and AD2. When the detection antenna elements AD1 and AD2 receive the target signal SP, a path difference R is formed between the detection antenna elements AD1 and AD2 by the transmission of the target signal SP, and its definition is according to the following equation (1).

$$R=D\cdot\sin\theta \tag{1}$$

where "R" represents the path difference R, "D" represents the distance D between the detection antenna elements AD1 and AD2, and "0" represents the azimuth angle θ of the target signal SP.

Since the distance D is known and equal to 0.5 wavelength of the common operation frequency of the antenna system 600, the processor 670 can estimate the azimuth angle θ of the target signal SP by analyzing the path difference R and the distance D of the detection antenna elements AD1 and AD2.

In some embodiments, the processor 670 generates the control voltage VC with a high logic level during the first stage, and generates the control voltage VC with a low logic level during the second stage, so as to optimize the variable impedance value of the tunable impedance circuit 120.

Figure 8:
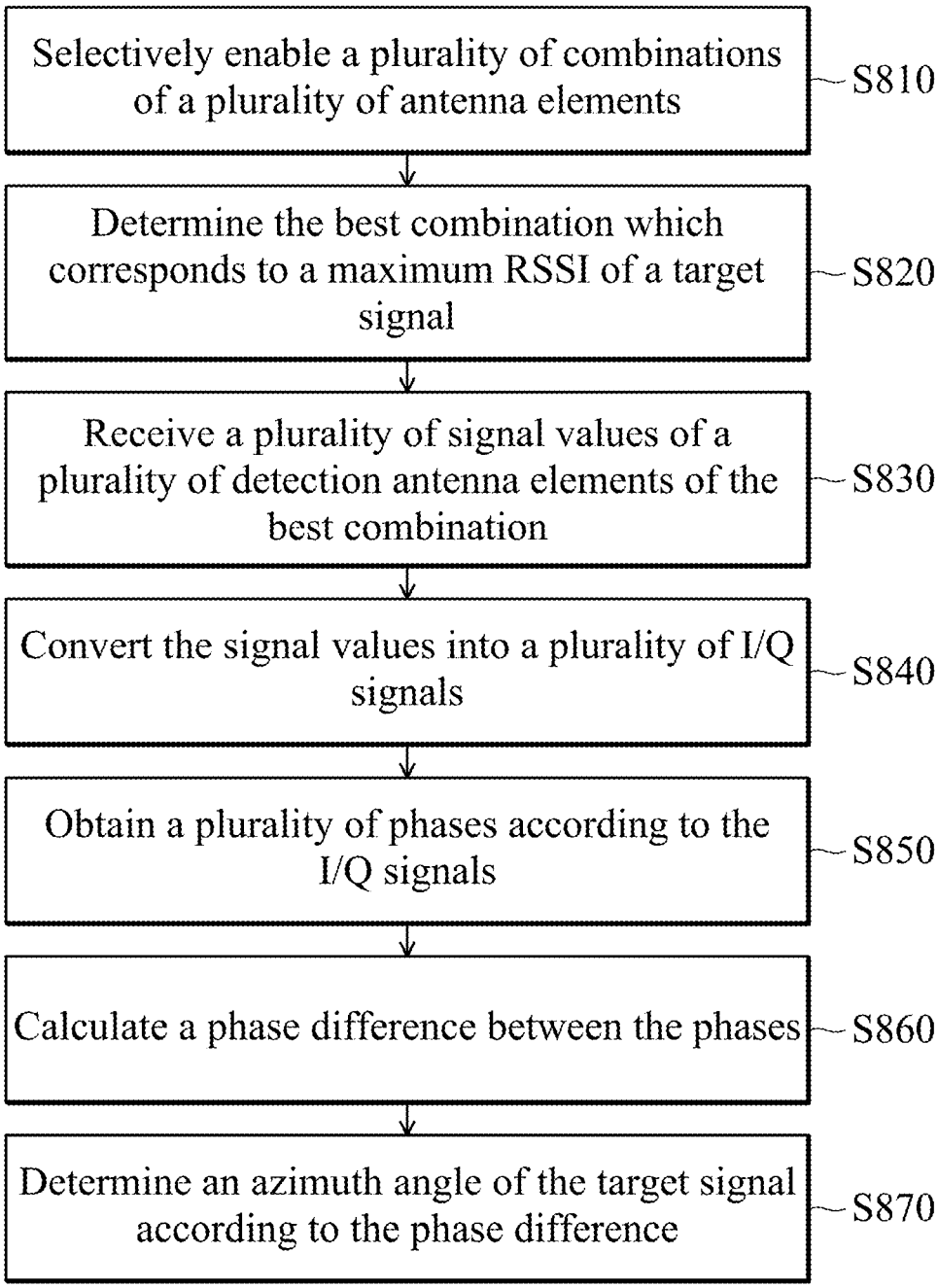
FIG. 8 is a flowchart of operations of an antenna system according to an embodiment of the invention.

FIG. 8 is a flowchart of operations of the antenna system 600 according to an embodiment of the invention, which includes the first stage and the second stage as described above. In the embodiment of FIG. 8, the operations of the antenna system 600 include the following steps. In the step S810, a plurality of combinations of a plurality of antenna elements are selectively enabled. In the step S820, the best combination is determined, and the best combination corresponds to the maximum RSSI of the target signal SP. In the step S830, a plurality of signal values of a plurality of detection antenna elements of the best combination are received. In the step S840, the signal values are converted into a plurality of I/Q (In-phase/Quadrature) signals. In the step S850, a plurality of phases are obtained according to the I/Q signals. In the step S860, a phase difference between the phases is calculated. In the step S870, an azimuth angle θ of the target signal SP is determined according to the phase difference. It should be noted that the aforementioned AoA calculation operation may include the steps S830 to S870.

Figure 9:
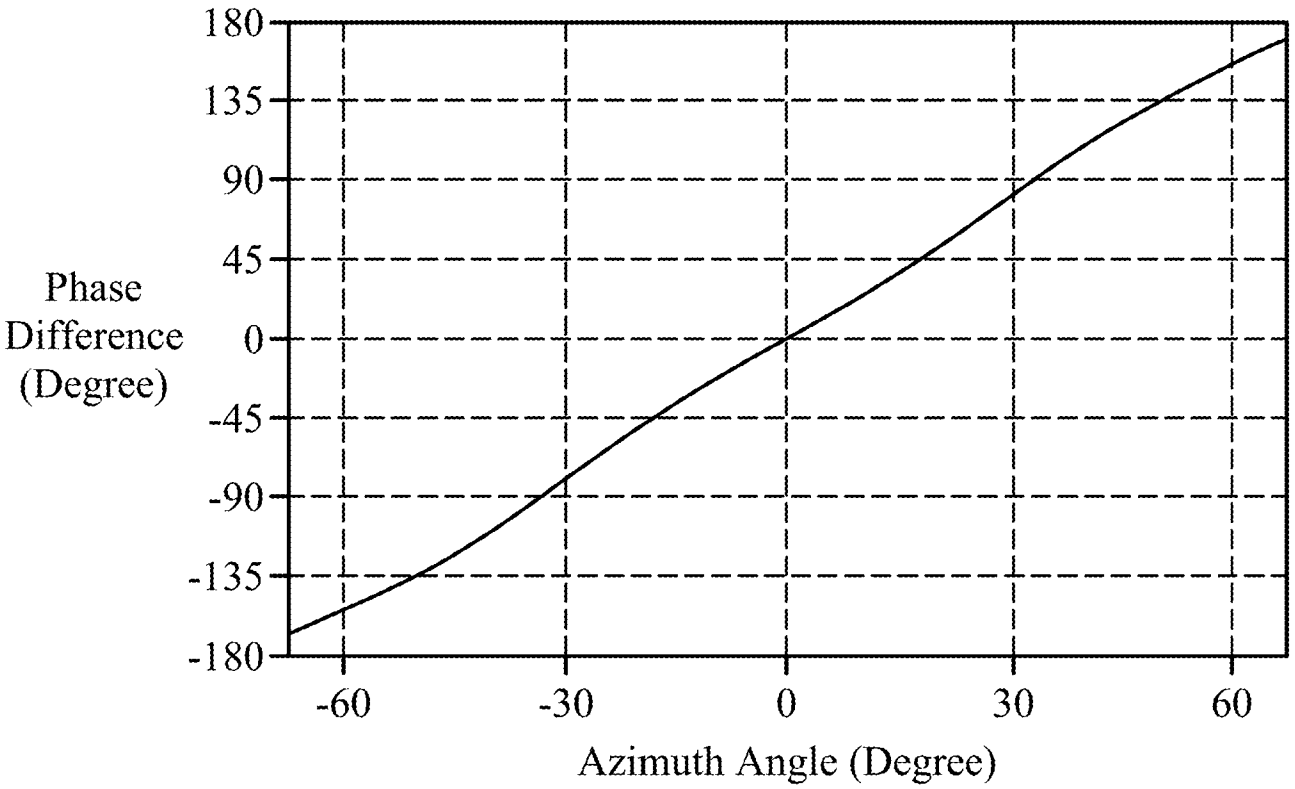
FIG. 9 is a diagram of relationship between a phase difference and an azimuth angle according to an embodiment of the invention.

FIG. 9 is a diagram of the relationship between the phase difference and the azimuth angle θ according to an embodiment of the invention. In the embodiment of FIG. 9, the processor 670 can calculate and obtain the azimuth angle θ of the target signal SP according to the phase difference between the detection antenna elements AD1 and AD2.

It should be noted that the processor 670 roughly estimates the DoA of the target signal SP during the first stage, and then performs the AoA calculation operation to precisely determine the azimuth angle θ of the target signal SP during the second stage. Such a design with two stages can significantly reduce the calculation complexity and also enhance the whole efficiency of signal processing. In alternative embodiments, if there are three antenna systems 100 used for respectively measuring the azimuth angle θ of the target signal SP, the detailed coordinates of the target signal SP can be further estimated.

The invention proposes a novel antenna system. In comparison to the conventional design, the invention has at least the advantages of low complexity and high efficiency, and therefore the invention is suitable for application in a variety of communication devices.

Note that the above element sizes, element shapes, and frequency ranges are not limitations of the invention. An antenna designer can fine-tune these settings or values to meet different requirements. It should be understood that the antenna system of the invention is not limited to the configurations of FIGS. 1-9. The invention may merely include any one or more features of any one or more embodiments of FIGS. 1-9. In other words, not all of the features displayed in the figures should be implemented in the antenna system of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

While the invention has been described by way of example and in terms of the preferred embodiments, it is to be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An antenna system, comprising:

a tunable impedance circuit;

a power splitter, having a common port, a first port, a second port, a third port, and a fourth port, wherein the common port of the power splitter is coupled to the tunable impedance circuit;

a first phase shifter, providing a first compensation phase;

a second phase shifter, providing a second compensation phase;

a third phase shifter, providing a third compensation phase;

a fourth phase shifter, providing a fourth compensation phase;

a first antenna element;

a second antenna element;

a third antenna element;

a fourth antenna element;

a first switch element, selectively coupling the first antenna element through the first phase shifter to the first port of the power splitter;

a second switch element, selectively coupling the second antenna element through the second phase shifter to the second port of the power splitter;

a third switch element, selectively coupling the third antenna element through the third phase shifter to the third port of the power splitter; and a fourth switch element, selectively coupling the fourth antenna element through the fourth phase shifter to the fourth port of the power splitter;

wherein the tunable impedance circuit comprises:

a first capacitor, wherein the first capacitor has a first terminal coupled to a first node, and a second terminal coupled to a ground voltage;

a first inductor, wherein the first inductor has a first terminal coupled to the first node, and a second terminal coupled to a second node;

wherein the second node is coupled to the common port of the power splitter;

a PIN diode, wherein the PIN diode has an anode coupled to a third node, and a cathode coupled to the second node;

a second capacitor, wherein the second capacitor has a first terminal coupled to the third node, and a second terminal coupled to the ground voltage;

a second inductor, wherein the second inductor has a first terminal coupled to the third node, and a second terminal coupled to a fourth node; and a third capacitor, wherein the third capacitor has a first terminal coupled to the fourth node, and a second terminal coupled to the ground voltage.

2. The antenna system as claimed in claim 1, wherein the antenna system supports communication of a Bluetooth frequency band.

3. The antenna system as claimed in claim 1, wherein the tunable impedance circuit further comprises:

a resistor, wherein the resistor has a first terminal coupled to the fourth node, and a second terminal coupled to a fifth node for receiving a control voltage; and a third inductor, wherein the third inductor has a first terminal coupled to the second node, and a second terminal coupled to the ground voltage.

4. The antenna system as claimed in claim 3, wherein if the control voltage has a high logic level, the PIN diode is turned on, and if the control voltage has a low logic level, the PIN diode is turned off.

5. The antenna system as claimed in claim 3, further comprising:

a processor, generating the control voltage, and controlling the first phase shifter, the second phase shifter, the third phase shifter, the fourth phase shifter, the first switch element, the second switch element, the third switch element, and the fourth switch element.

6. The antenna system as claimed in claim 5, wherein during a first stage, the processor enables three or four of the first antenna element, the second antenna element, the third antenna element, and the fourth antenna element by switching the first switch element, the second switch element, the third switch element, and the fourth switch element.

7. The antenna system as claimed in claim 6, wherein during the first stage, the processor selects one of the first antenna element, the second antenna element, the third antenna element, and the fourth antenna element as a target antenna element according to a target signal.

8. The antenna system as claimed in claim 7, wherein when the target antenna element is selected, a radiation pattern of the antenna system substantially covers a DoA (Direction of Arrival) of the target signal.

9. The antenna system as claimed in claim 7, wherein the target antenna element corresponds to a maximum RSSI (Received Signal Strength Indicator) of the target signal.

10. The antenna system as claimed in claim 7, wherein during a second stage, the processor further selects two of the first antenna element, the second antenna element, the third antenna element, and the fourth antenna element as two detection antenna elements, and the detection antenna elements are both adjacent to the target antenna element.

11. The antenna system as claimed in claim 10, wherein during the second stage, the processor performs an AoA (Angle of Arrival) calculation operation by using the detection antenna elements, so as to determine an azimuth angle of the target signal.

12. The antenna system as claimed in claim 11, wherein the AoA calculation operation comprises: receiving a plurality of signal values of the detection antenna elements, converting the signal values into a plurality of I/Q (In-phase/Quadrature) signals, obtaining a plurality of phases according to the I/Q signals, calculating a phase difference between the phases, and determining the azimuth angle of the target signal according to the phase difference.

13. The antenna system as claimed in claim 1, wherein each of the first compensation phase, the second compensation phase, the third compensation phase, and the fourth compensation phase is substantially equal to 0 degrees, is from 280 to 300 degrees, or is from 100 to 120 degrees.

14. The antenna system as claimed in claim 1, wherein each of the first antenna element, the second antenna element, the third antenna element, and the fourth antenna element is a monopole antenna or a PIFA (Planar Inverted F Antenna).

15. The antenna system as claimed in claim 1, wherein a HPBW (Half-Power Beamwidth) of the antenna system is substantially equal to 90 degrees.

16. The antenna system as claimed in claim 1, wherein the first antenna element, the second antenna element, the third antenna element, and the fourth antenna element have a common operation frequency which is substantially equal to 2.45 GHz.

17. The antenna system as claimed in claim 16, wherein the first antenna element, the second antenna element, the third antenna element, and the fourth antenna element are positioned at each central point of four sides of a square shape, respectively.

18. The antenna system as claimed in claim 17, wherein a length of each of the sides of the square shape is substantially equal to 0.5 wavelength of the common operation frequency.

* * * * *